US011938371B2

(12) United States Patent
Sbalbi

(10) Patent No.: US 11,938,371 B2
(45) Date of Patent: Mar. 26, 2024

(54) FACE TOOLS

(71) Applicant: Giada Sbalbi, Crema (IT)

(72) Inventor: Giada Sbalbi, Crema (IT)

(73) Assignee: Giada Sbalbi, Crema (IT)

( * ) Notice: Subject to any disclaimer, the term of this patent is extended or adjusted under 35 U.S.C. 154(b) by 543 days.

(21) Appl. No.: 17/043,079

(22) PCT Filed: Apr. 24, 2019

(86) PCT No.: PCT/IB2019/053370
§ 371 (c)(1),
(2) Date: Sep. 29, 2020

(87) PCT Pub. No.: WO2019/207495
PCT Pub. Date: Oct. 31, 2019

(65) Prior Publication Data

US 2021/0016134 A1 Jan. 21, 2021

(30) Foreign Application Priority Data

Apr. 27, 2018 (IT) ..... 102018000004957

(51) Int. Cl.
*A63B 23/03* (2006.01)
*A63B 21/06* (2006.01)
*A63B 71/00* (2006.01)

(52) U.S. Cl.
CPC ..... *A63B 23/03* (2013.01); *A63B 21/0604* (2013.01); *A63B 71/0036* (2013.01); *A63B 2208/0252* (2013.01)

(58) Field of Classification Search
CPC ..... A63B 1/065; A63B 23/025; A63B 23/03
See application file for complete search history.

(56) References Cited

U.S. PATENT DOCUMENTS 2,882,892 A * 4/1959 Kosior ..... A45D 44/22 601/1
3,525,141 A * 8/1970 Smith ..... A63B 21/065 29/428
3,924,851 A * 12/1975 Winston ..... A63B 21/4021 482/105
4,189,141 A * 2/1980 Rooney ..... A63B 23/03 482/11
4,195,833 A * 4/1980 Svendsen ..... A63B 21/065 482/11
4,396,190 A * 8/1983 Wilkerson ..... A63B 21/065 273/DIG. 30
4,632,389 A * 12/1986 Moss ..... A42B 1/24 273/DIG. 30
4,666,148 A * 5/1987 Crawford ..... A63B 23/03 482/901
D297,658 S * 9/1988 Winston ..... D21/683
4,823,778 A * 4/1989 Ewing ..... A45D 44/22 606/204.35

(Continued)

*Primary Examiner* — Nyca T Nguyen

(57) ABSTRACT

Tool for tonifying face and neck muscles, extending in a longitudinal direction (X-X) corresponding to the lengthwise dimension of the tool, transverse dimension (Y-Y) corresponding to a widthwise dimension of the tool and vertical direction (Z-Z) corresponding to the thickness of the tool, comprising: a container (10;110) comprising several single housings (11;111); —a series of weights (20;120), each singly contained inside a respective housing of the container (10;110).

31 Claims, 9 Drawing Sheets

(56) References Cited

U.S. PATENT DOCUMENTS 4,838,546 A * 6/1989 Winston ..... A63B 21/4013 482/105
4,997,183 A * 3/1991 Winston ..... A63B 21/065 482/74
5,076,575 A * 12/1991 Eylander ..... A63B 21/065 482/139
5,127,891 A * 7/1992 Winston ..... A63B 21/065 482/50
5,144,694 A * 9/1992 Conrad Da oud ... A63B 21/065 D2/737
5,458,617 A * 10/1995 Bystrom ..... A63B 21/065 606/241
5,702,330 A * 12/1997 De Monbrun ..... A63B 21/065 128/842
6,039,677 A * 3/2000 Spletzer ..... A63B 21/065 2/22
6,058,535 A * 5/2000 Firkins, Jr. ..... A47C 7/021 297/219.1
6,113,521 A * 9/2000 Winston ..... A63B 21/065 482/50
6,671,887 B1 * 1/2004 Eligan ..... A63B 21/065 2/228
6,939,273 B2 * 9/2005 Zajac ..... A63B 21/06 482/109
D657,832 S * 4/2012 Beber ..... D21/683
9,526,944 B2 * 12/2016 Knies ..... A63B 21/4003
9,604,091 B2 * 3/2017 Haley ..... A63B 24/0087
2004/0043875 A1 * 3/2004 Lederfeind ..... A63B 21/4009 482/105
2007/0099774 A1 * 5/2007 Bruback ..... A63B 21/0602 482/105
2009/0253560 A1 * 10/2009 Cook ..... A63B 21/4007 482/105
2010/0000006 A1 * 1/2010 Butler ..... A63B 21/0605 2/160
2011/0201478 A1 * 8/2011 Friend ..... A63B 21/4005 482/13
2016/0016039 A1 * 1/2016 Knies ..... A63B 23/03 482/11
2016/0332031 A1 * 11/2016 Joseph ..... A63B 21/4009
2019/0046829 A1 * 2/2019 Tran ..... A63B 21/4013
2019/0247699 A1 * 8/2019 Gineris ..... A63B 21/4015
2019/0321677 A1 * 10/2019 Turner ..... A41D 13/1236
2021/0016134 A1 * 1/2021 Sbalbi ..... A63B 21/00065

* cited by examiner

20; 120

20; 120

20; 120

FACE TOOLS

CROSS-REFERENCE TO RELATED APPLICATIONS

The instant application claims priority to International Application No. PCT/IB2019/053370, filed on Apr. 24, 2019, which claims priority to Italian Application No. 102018000004957, filed on Apr. 27, 2018, the contents of which are hereby incorporated by reference.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

The present invention relates to at least one tool for tonifying the face and neck superficial muscles and to a method for the cosmetic treatment of the face and/or neck by means of said at least one tool.

It is known that aging causes in the human body a relaxation of the muscles which in the specific case of the faces muscles results in the formation of wrinkles, bags, blepharochalasis and the like.

It is also known in the technical sector of cosmetic face treatment to use substances which are designed to inhibit temporarily the mimetic face muscles, reducing the formation of expression wrinkles.

These substances are applied by means of invasive procedures, such as subcutaneous injections, which require the services of expert, qualified and also authorized personnel.

In addition to the risks associated with the administration described above, these products may cause allergic reactions since, having only a limited effect over time, they require multiple applications.

In addition to the above also known are tools for tonifying face muscles for example described in U.S. Pat. Nos. 4,189,141 and 2,882,892 which each illustrate a cloth mask which is elastically deformable so that it may be applied to different head and face structures, being held against the user's head by retaining straps. The known masks have substantial defects in that they cannot be specifically and selectively applied to specific areas of the face and are therefore not precise with respect to the single muscles. In addition, the known masks act by resisting the expansion movement of the muscles on parts of the face and require a greater effort by the deep-lying muscles of the face and neck and by the articulations. The mask is worn for use by the user when standing.

U.S. Pat. No. 4,195,833 describes a band to be applied to the forehead of a user in order to increase the weight acting on the neck during the exercise which involves an up-and-down rotation of the user's head in order to strengthen the deep-lying muscles of the neck.

U.S. Pat. No. 4,632,389 describes a band provided with retaining fixing means of the Velcro © or similar type designed to be fixed to any part of the body and provided with means for combination with different gram weights.

The technical problem which is posed therefore is that of developing instruments which are able to produce a tonifying effect on the face and/or neck muscles, such as to prevent the formation of wrinkles, bags, blepharochalasis, etc., without the need for administration of artificial products and/or surgical operations and with lasting effects over time.

In connection with this problem it is also required that these instruments should have small dimensions, be easy and inexpensive to produce and assemble and be easy to use both autonomously by any user, including non-specialized users, and within structures such as beauty centres, gyms and the like.

BRIEF SUMMARY OF THE INVENTION

These results are achieved according to the present invention by a tool for tonifying face and neck muscles according to the characteristic features described further herein and by a method for the cosmetic treatment of the face and/or neck by means of one or more tools according to the invention as per the characteristic features described herein.

The Applicant has surprisingly discovered that a tool with these characteristic features, which makes use solely of the gripping action of the stable positioning elements on the zone concerned when the tool is resting on the face or neck of the user lying in a supine position, stimulates the superficial muscle system of the zone concerned on the face and/or neck, allowing the superficial muscle to support the dermis creating tonifying, firming and lifting effects which result in a gradual relaxation of the epidermis with a visible reduction in signs of aging, without applying any force to the deep-lying muscles and to the articulations or to muscles where stimulation does not result in any beneficial aesthetic effects.

In a further aspect, the invention relates to a tool for tonifying superficial muscles of a face and/or neck, extending respectively in a longitudinal direction corresponding to a lengthwise dimension of the tool, transverse direction corresponding to a widthwise dimension of the tool, and vertical thickness direction of the tool, comprising a container comprising several single housings, and a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position; wherein said container is made of a plastic or rubbery material and said positioning element is formed by the plastic or rubbery material of the external surface of the container with a coefficient of friction such as to ensure a sufficient grip on the specific area of the face and/or neck of the user on which it rests; wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, wherein the container comprises two half-shells, each subdivided into recesses designed to contain a fraction of the volume of the respective weight and to form a respective housing of the container once coupled with a respective recess of the other half-shell.

In a further aspect, the invention relates to a tool for tonifying superficial muscles of a face and/or neck, extending respectively in a longitudinal direction corresponding to a lengthwise dimension of the tool, transverse direction corresponding to a widthwise dimension of the tool, and vertical thickness direction of the tool, comprising a container comprising several single housings and a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position; wherein said container is made of a plastic or rubbery material and said positioning element is formed by the plastic or rubbery material of the external surface of the container with a coefficient of friction such as to ensure a sufficient grip on the specific area of the face and/or neck of the user on which it rests; wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, and further comprising a hinge with a longitudinal axis designed to join in the transverse direction a longitudinal side of a housing of the container together with an opposite longitudinal side of an adjacent housing in the transverse direction, so as to allow a degree of freedom for relative rotation of the adjacent housings about the longitudinal axis.

In a further aspect, the invention relates to a tool for tonifying superficial muscles of a face and/or neck, extending respectively in a longitudinal direction corresponding to a lengthwise dimension of the tool, transverse direction corresponding to a widthwise dimension of the tool, and vertical thickness direction of the tool, comprising a container comprising several single housings and a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position; wherein said container is made of a plastic or rubbery material and said positioning element is formed by the plastic or rubbery material of the external surface of the container with a coefficient of friction such as to ensure a sufficient grip on the specific area of the face and/or neck of the user on which it rests; wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, and wherein the tool has an "L" shaped form or a hollow rectangle form.

The present invention relates furthermore to a tool kit according to other characteristic features described herein.

BRIEF DESCRIPTION OF THE SEVERAL VIEWS OF THE DRAWING

Further details may be obtained from the following description of a non-limiting example of embodiment of the subject of the present invention provided with reference to the attached drawings in which.

Figure 1:
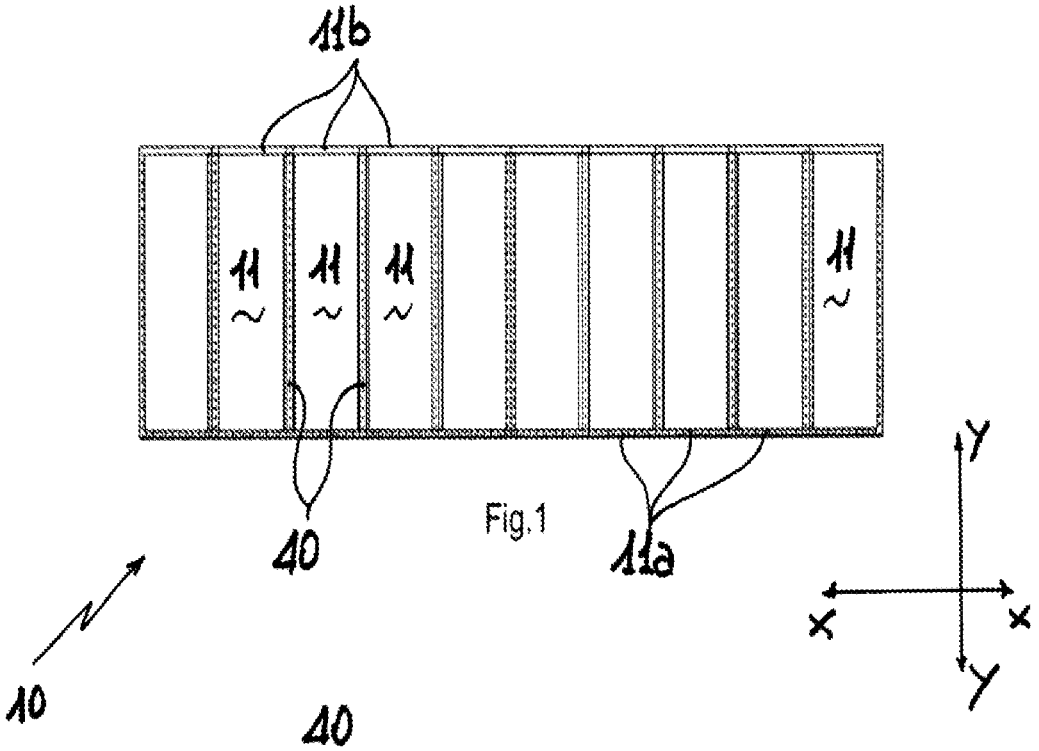
FIG. 1: shows a front view of a first example of embodiment of a container for weights of the tool according to the present invention.

For the sake of easier description and without a limiting meaning a set of three reference axes is assumed, i.e. in a longitudinal direction X-X, corresponding to a lengthwise dimension of the tool, transverse direction Y-Y corresponding to the widthwise dimension of the tool, and vertical direction Z-Z orthogonal to the other two directions and corresponding to the thickness dimension of the tool, as well as conventionally a front part A and a rear part P indicated in the figures.

DETAILED DESCRIPTION OF THE INVENTION

Based on these definitions a preferred example of a tool according to the present invention for tonifying face and/or neck muscles comprises essentially:

a container 10 comprising several single housings;

a series of weights 20 singly contained inside each housing of the container 10.

In a first embodiment the container 10 has housings in the form of bags 11 with a closed bottom 11*a* and a mouth 11*b* to which reversible closing means 30 are applied. A side 11*c* extending parallel to the transverse direction Y-Y of each bag 11 is fastened to a corresponding side of the adjacent bag by hinge means 40 designed to allow a degree of freedom for rotation about the said transverse side.

According to preferred embodiments of the tool, the weights 20 are made with a different gram weight in order to produce a different action on the corresponding muscle at the time of use.

Figure 3:
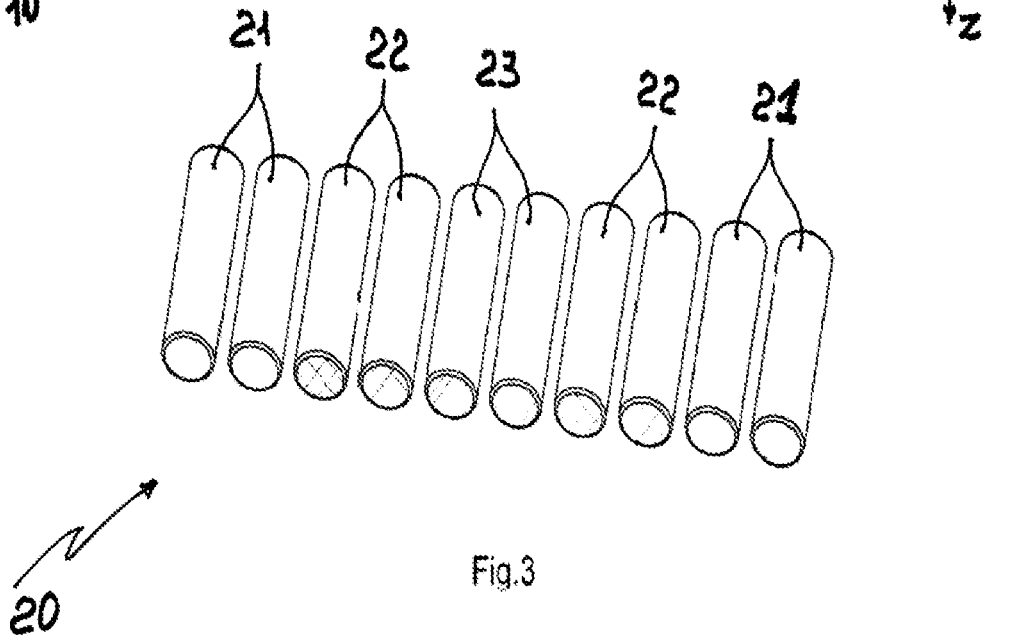
FIG. 3: shows a perspective view of a first example of embodiment of weights for the container according to FIG. 1.

As shown in FIG. 3, a symmetrical embodiment is for example envisaged, with lighter end weights 21, intermediate weights 22 with a greater gram weight than that of the end weights, and central weights 23 with a gram weight higher than all the other weights.

As will appear more clearly below, it is possible to have in any case combinations of weights and arrangements thereof depending on requirements.

Figure 2:
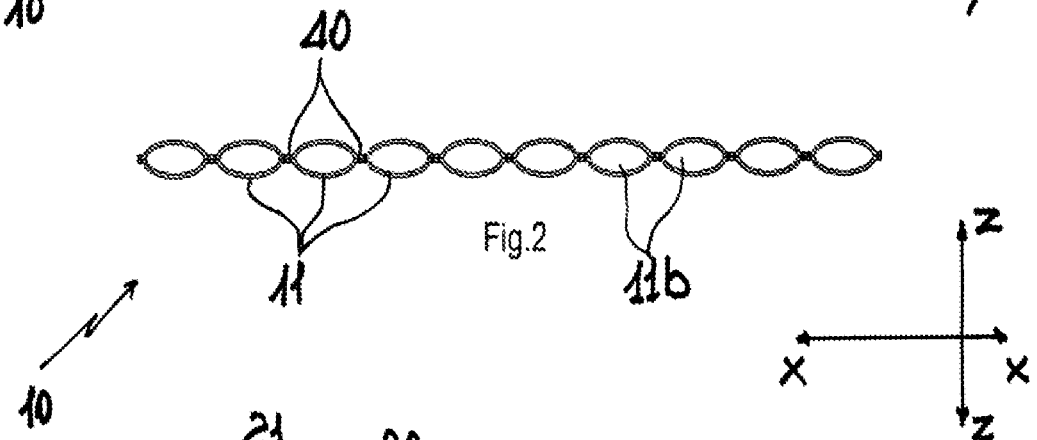
FIG. 2: shows a top plan view of the container according to FIG. 1.

In order to assemble the tool in its embodiment shown in FIGS. 1-3 the weights 20 are inserted inside the corresponding bags 11 through the open mouth 11*a*; once insertion has been performed the bags are closed by means of the closing means 40.

Figure 4:
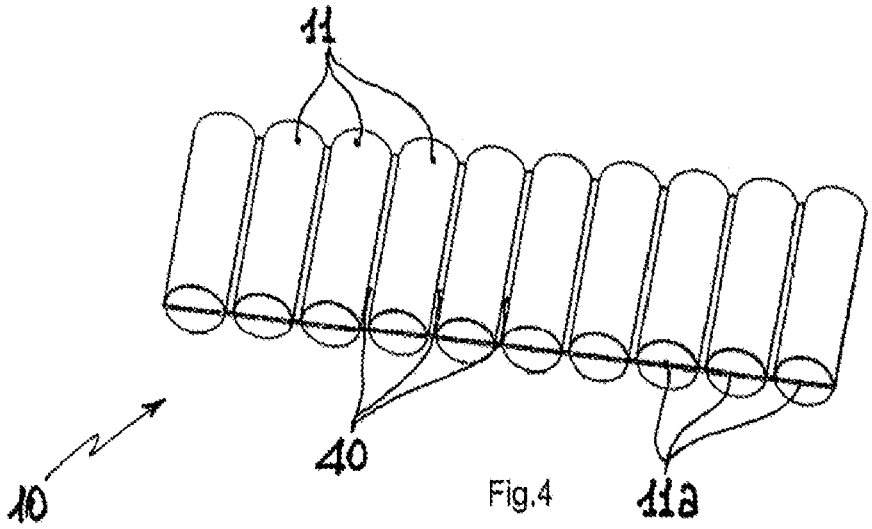
FIG. 4: shows a perspective view of an assembled tool.
Figure 5:
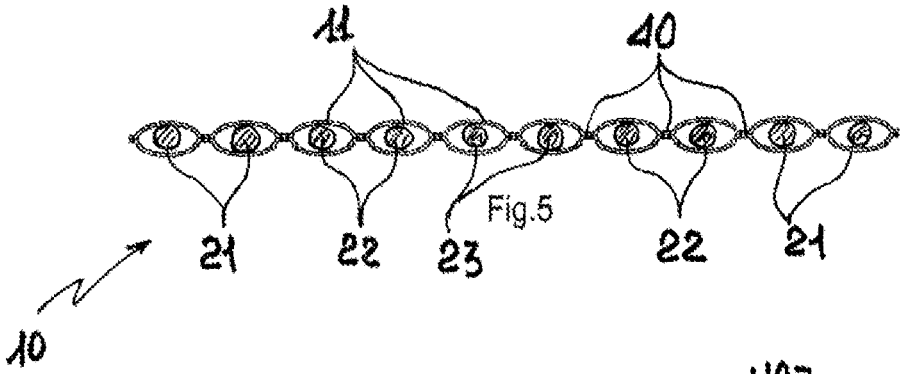
FIG. 5: shows a cross-section along the plane V-V of FIG. 4.

As shown in FIGS. 4 and 5, the assembled tool ready for use is in the form of a strip elongated in the longitudinal direction X-X and comprising a plurality of pockets 11 which are hinged together and each of which has an associated weight inside it.

Figure 6:
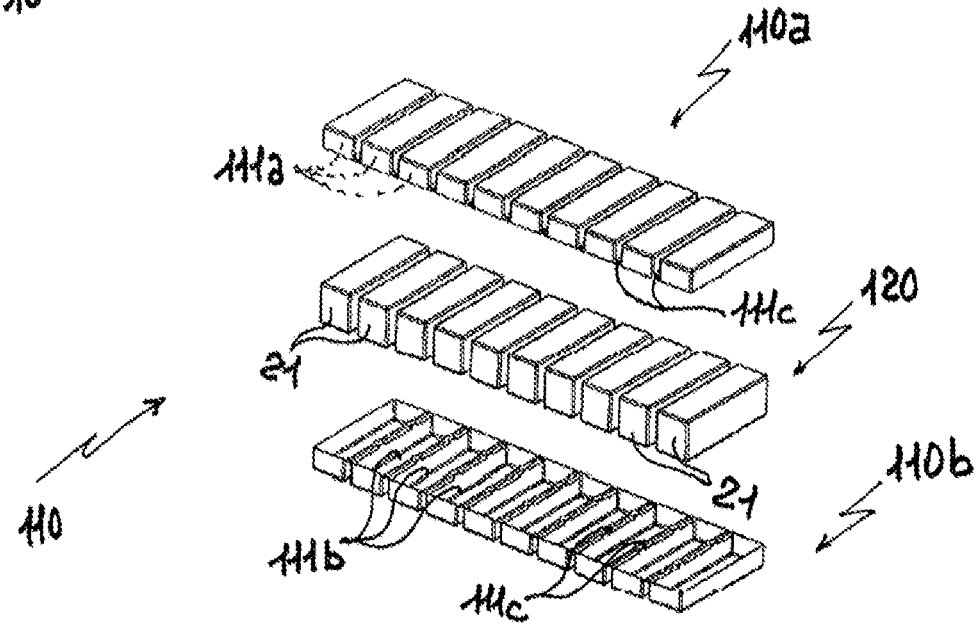
FIG. 6: shows an exploded perspective view of a second embodiment of a tool according to the present invention.

FIG. 6 shows a further embodiment of the tool according to the invention where the container 110 comprises two half-shells 110*a*,110*b*, each divided into recesses 111*a*,111*b* with a volume corresponding to a half fraction—or a different matching fraction—of the volume of the respective weight 120 which it must contain.

A side 111*c* extending parallel to the transverse direction Y-Y of each recess 111*a*,111*b* is fastened to the corresponding side of the adjacent recess by hinge means 140 designed to allow the said degree of freedom for relative rotation of the seats about the said common transverse side.

In the embodiment shown in FIG. 6 said hinge means 140 comprise thin strips 141 of material, the flexibility of which ensures the necessary degree of freedom for relative rotation.

Said strips 141 may be continuous and/or discontinuous.

For assembly of the tool, the weights 120 are inserted inside the respective recess of a half-shell and the tool is closed by placing it on top of the other half-shell and fastening the half-shells together using technology suitable for the type of material used for the containers.

Both in the bag embodiment 11 and in the half-shell embodiment 111 it is envisaged that the containers 10,110 may be made of plastic or rubbery material, in particular silicone material, where both the bag closing means 30 and the hinge means 40 may be realized by means of ultrasound welding, gluing, hooks or the like, resulting in this case in a non-modifiable stable configuration, in particular suitable for uses where a tailor-made form is required.

The possibility of producing different types of casing also means that alternatives may be offered for users who have allergies.

Figure 7:
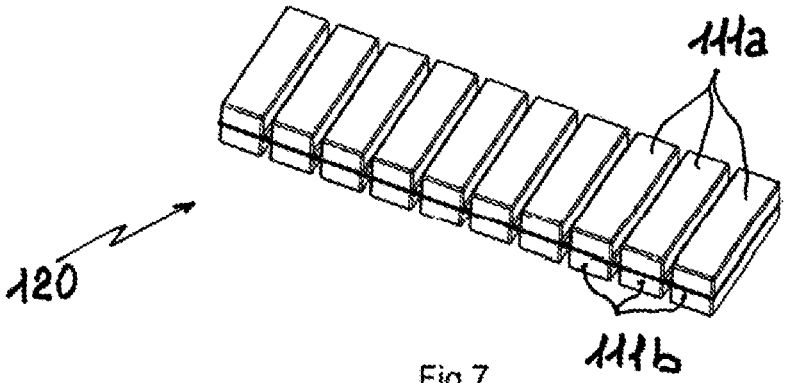
FIG. 7: shows a perspective view of the tool according to FIG. 6 in the assembled condition.
Figure 8:
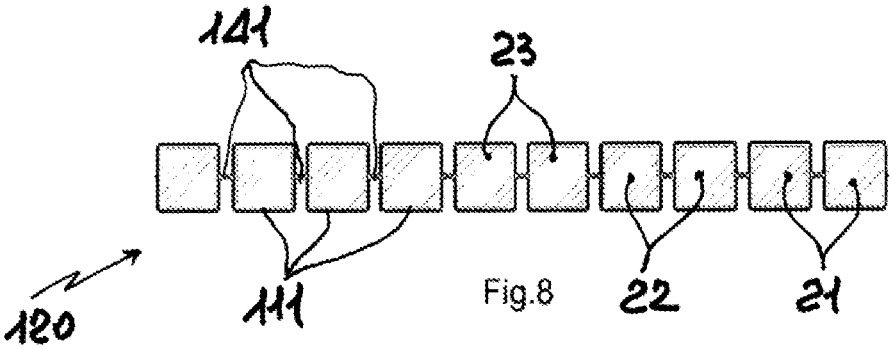
FIG. 8: shows a schematic cross-section along the plane VIII-VIII of FIG. 7.
Figure 9:
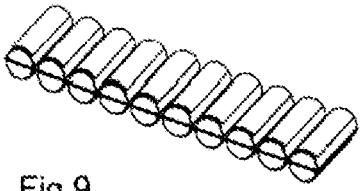
FIGS. 9-11: show schematic views of further embodiments of a tool according to the invention, specifically designed for application to the neck of a user.
Figure 10:
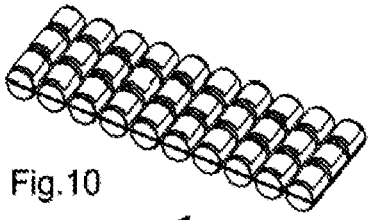
Figure 11:
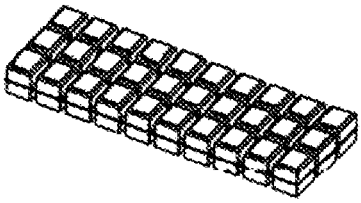

As shown it is envisaged that the weights may assume the following forms:

cylindrical, uniform, elongated in the transverse direction (FIGS. 3, 9), and/or cylindrical, uniform with a longitudinal dimension substantially corresponding to the longitudinal dimension (FIG. 10) and/or;

parallelepiped, uniform, elongated in the transverse direction (FIGS. 6,7), and/or;

parallelepiped, uniform with a transverse dimension substantially corresponding to the longitudinal dimension (FIG. 11).

Figure 18:
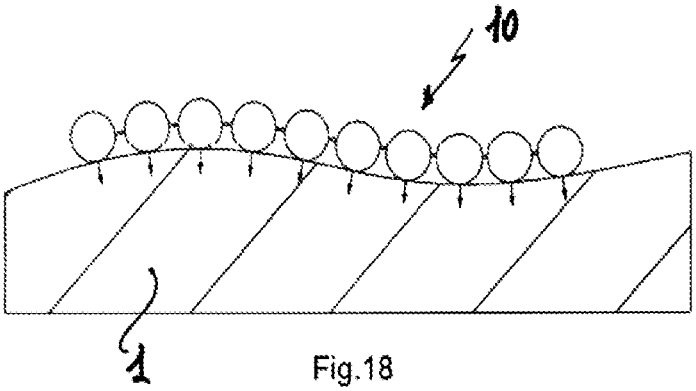
FIGS. 18-19: show schematic graphs of the force lines generated by the tool and acting on different surfaces of the user's face.
Figure 19:
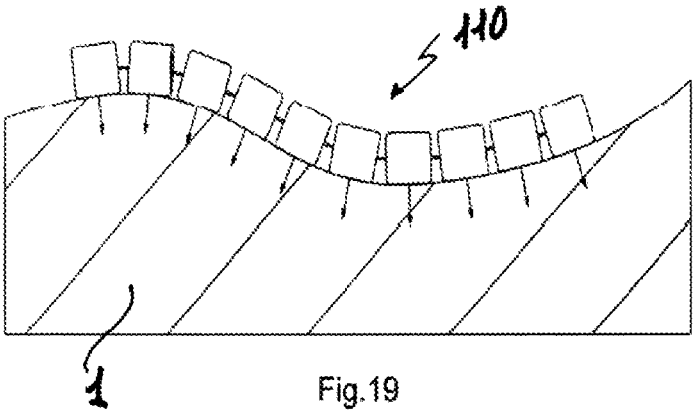

The two embodiments with a transverse dimensions substantially corresponding to the longitudinal dimension are preferred if it is required to ensure (FIGS. 18, 19) an improved distribution of the weights in contact with the underlying muscles 1 whatever the concave or convex surface on which the tool acts.

Figure 25:
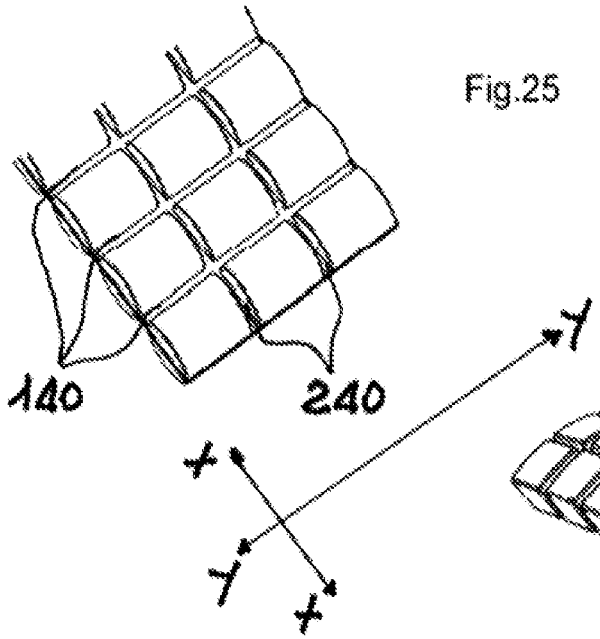
FIG. 25: shows a perspective view from above of the detail of a tool according to the invention with a dual degree of freedom of rotation.
Figure 27:
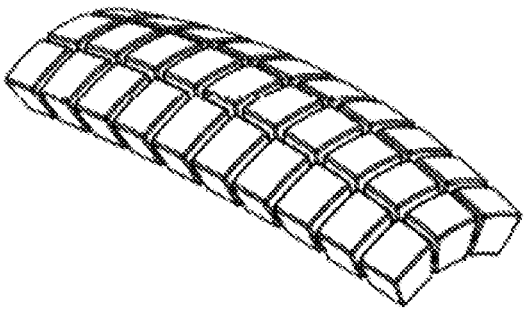
FIGS. 26-27: show perspective views of a tool according to the invention bent around hinges which are orthogonal to each other.
Figure 26:
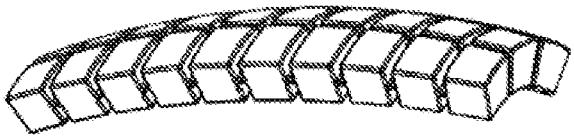

According to preferred embodiments of the invention and in particular (FIG. 25) for the weight forms with longitudinal and transverse dimensions substantially coinciding, it is also envisaged providing a further hinge 240 with a longitudinal axis X-X designed to join together in the transverse direction Y-Y a longitudinal side of at least one housing of the container 10,110 and an opposite longitudinal side of the adjacent housing, and preferably a hinge between each pair of adjacent housings in the transverse direction; in these configurations the tool therefore has hinges 140 with a transverse axis Y-Y and hinges 240 with a longitudinal axis X-X, allowing a second degree of freedom for rotation, particularly useful for those areas where it is required to adapt the tool to an underlying substantially spherical form where the tool must be deformed (FIGS. 26,27) along different lines of extension in order to ensure correct positioning on the underlying muscles.

According to further embodiments (FIGS. 12-15) it is envisaged that, irrespective as to whether they have a cylindrical, parallelepiped, ovoid or similar form, the central weights 123 may have a length in the transverse direction greater than the corresponding length of the side weights, projecting towards the front part A relative to the other weights of the tool.

Figure 16:
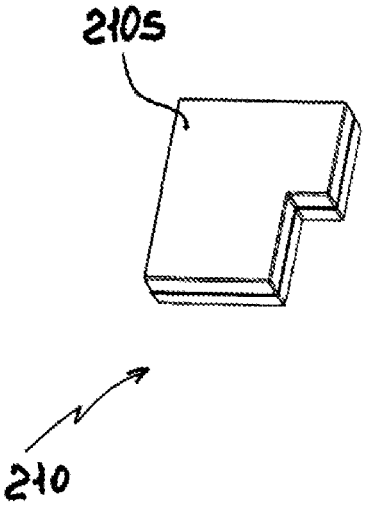
FIG. 16: shows perspective views of a further embodiment of a tool according to the invention, specifically designed for application to the cheeks of a user.
Figure 16:
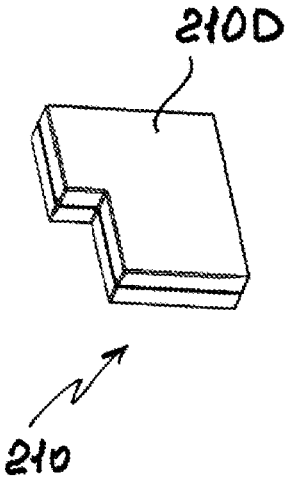

According to a further embodiment of a tool 210 according to the invention it is envisaged that the said tool may be formed as an overturned L (FIG. 16) which can be applied during use as a right-hand element 210D or a left-hand element 210S which are symmetrical with respect to an axis parallel to the transverse axis Y-Y passing along the nose.

Figure 28:
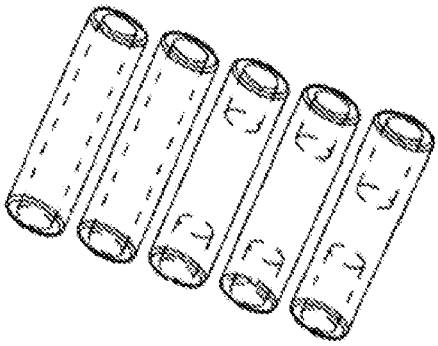
FIG. 28: shows a perspective view of partially hollow weights for tools according to the invention.

In addition to the above it is also envisaged (FIG. 28) that the weights may be at least partially internally hollow, independently of their external form, thus ensuring both a suitable surface for contact with the muscle and a correctly defined weight for the specific application/person.

Figure 12:
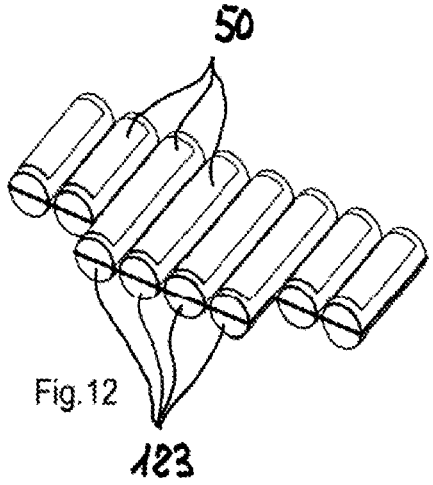
FIGS. 12-15: show schematic views of further embodiments of a tool according to the invention, specifically designed for application to the forehead of a user.
Figure 13:
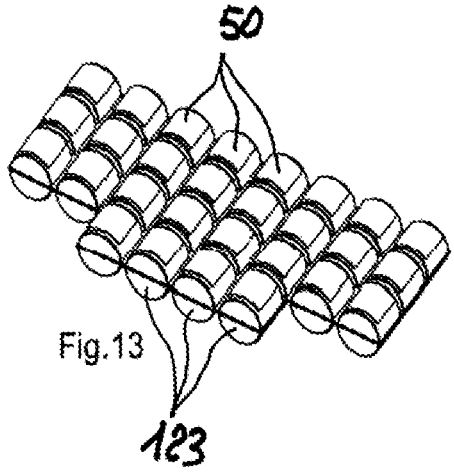
Figure 14:
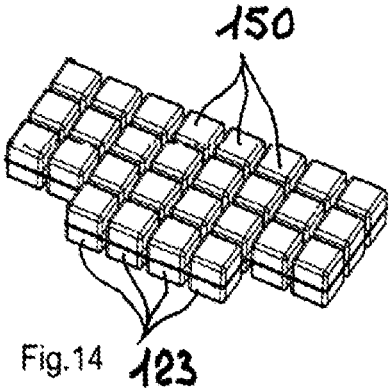
Figure 15:
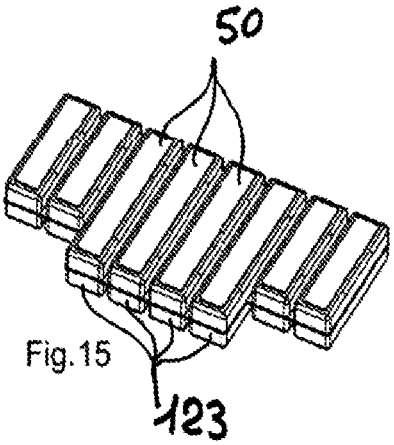

As shown in FIGS. 12, 13 and 15 it is also envisaged that at least one external surface of the pockets/bags containing the weights has an element 50 made of material suitable for ensuring the stable positioning of the tool when placed in the working zone.

Said stable positioning elements 50 may be made of adhesive material, for example in the form of a strip, tags or other form suitable for application on a specific area of the user.

Preferably these positioning elements comprise a material with a coefficient of friction such as to ensure a sufficient grip on the area or zone of the user's face and/or neck on which they merely rest. Preferably, this positioning element is made of the same plastic or rubbery material as the external surface of the said container 110.

The tool with weights according to the invention does not require in fact means for allowing them to be worn or held as normally occurs in the case of masks or other exercising tools of the prior art.

The tool with weights according to the invention is characterized by the absence of (active or passive) retaining means, such as belts or straps which fasten the tool to the user, but acts by making use solely of the gripping action of the stable positioning elements on the zone concerned (and the force of gravity) when the tool is placed on the face or neck of the user lying in a supine position.

This gives rise to numerous advantages including:

- the tool forms a system of free weights moved directly only by the muscular system of the zone of the face or neck concerned;
- only the gripping force of the positioning elements of the container and the force of gravity are used, the tool allowing the weight force to be concentrated in the specific area/zone of application.

In this way only the muscle system and in particular only the agonist muscles are stimulated (and not the articular system nor the antagonist muscles as in the case where weights fixed with retaining means are used); moreover the tool does not stimulate the deep-lying muscles (such as the masseter muscle) but only the superficial muscles of the face and/or neck zone concerned.

Owing to the presence of a hinge between two or more adjacent housings the tool may be more easily adapted to the specific face or neck zones whose superficial muscles are to be exercised, since the weights are contained inside a container which allows the different degrees of movement while always remaining firmly pressed on the face or neck of the user in the supine position with the aid of the gripping action of the positioning elements.

It is envisaged that the weights may be made using materials with a different specific weight depending on the final weight and preferred form of the weights and the total weight which the tool must have once assembled.

Figure 17:
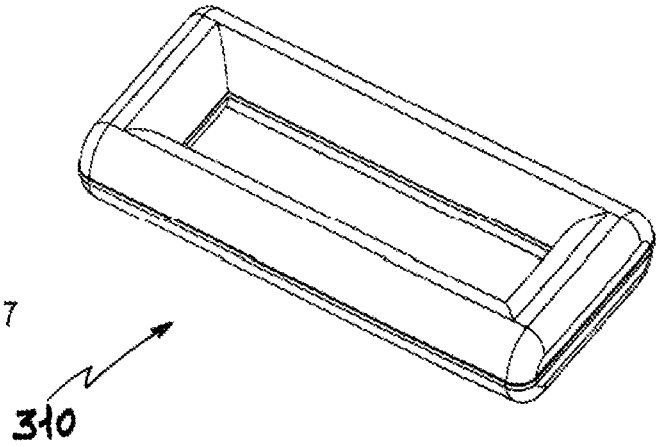
FIG. 17: shows a perspective view of a further embodiment of a tool according to the invention, specifically designed for application to the mouth of a user.
Figure 20:
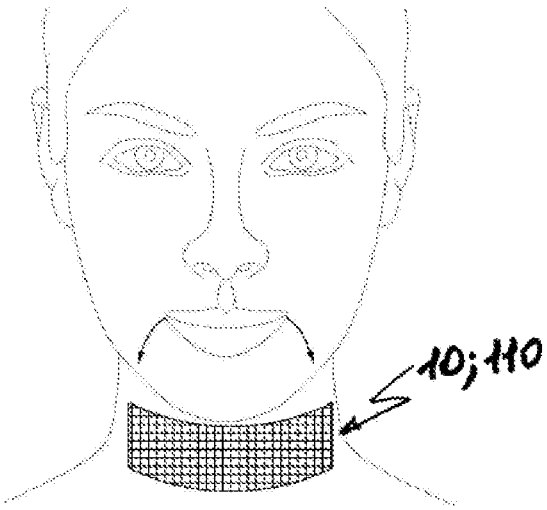
FIGS. 20-23: show views of the application of different tools applied to different and corresponding zones of the user's neck/face.
Figure 21:
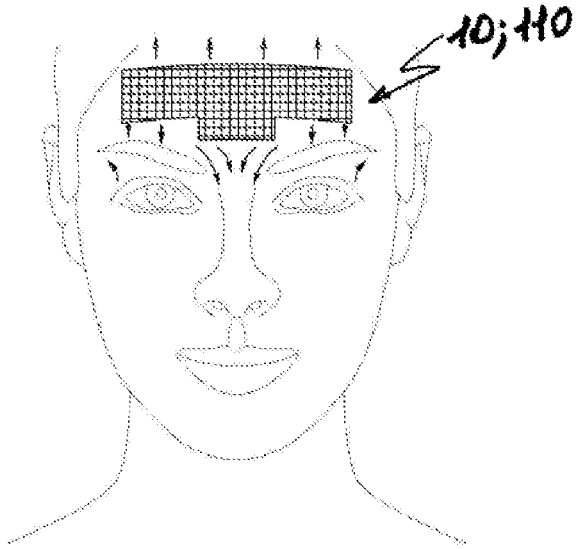
Figure 22:
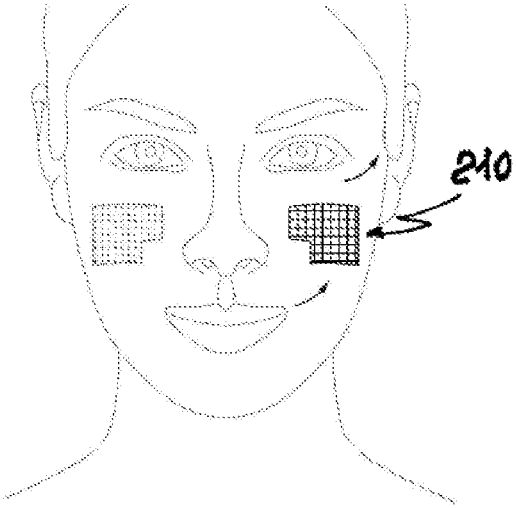
Figure 23:
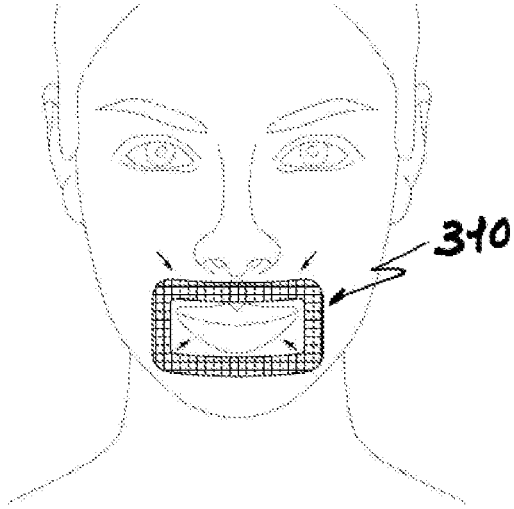

According to the invention it is envisaged that the different preferred embodiments of the tools are functionally designed for specific uses; in particular:

- the strips with weights of uniform length (FIGS. 4,7) are particularly suitable for application to the user's neck (FIG. 20);
- the strips with central weights of greater length (FIGS. 12-15) are particularly useful for application to the forehead of the user (FIG. 21);
- the L-shaped tools (FIG. 16) are particularly suitable for application to the user's cheeks (FIG. 22);
- the strips shaped as a hollow rectangle 310 (FIG. 17) are particularly suitable for application around the user's mouth (FIG. 23).

Figure 29:
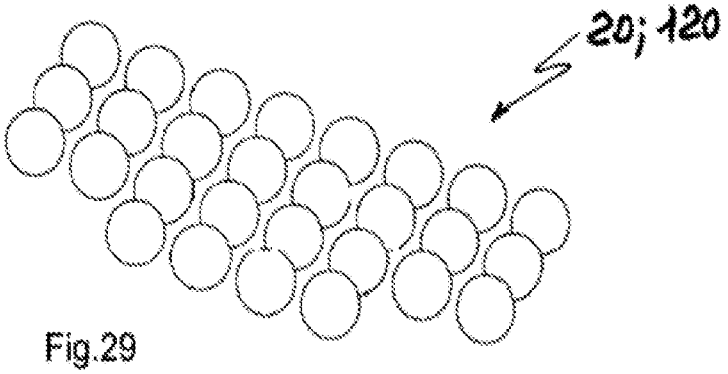
FIGS. 29-31: show perspective views of further examples of embodiment of weights for tools according to the invention.
Figure 30:
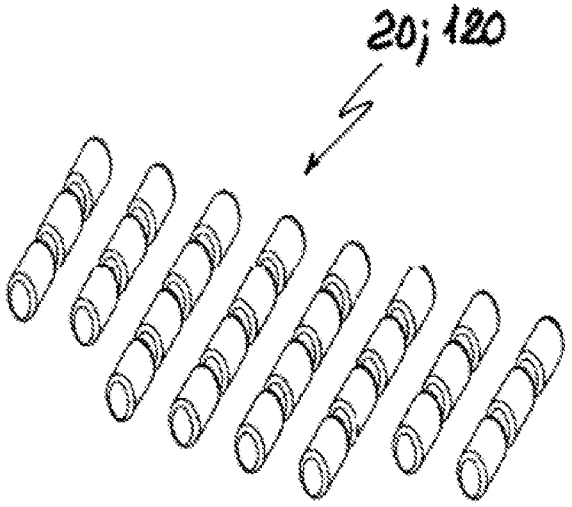
Figure 31:
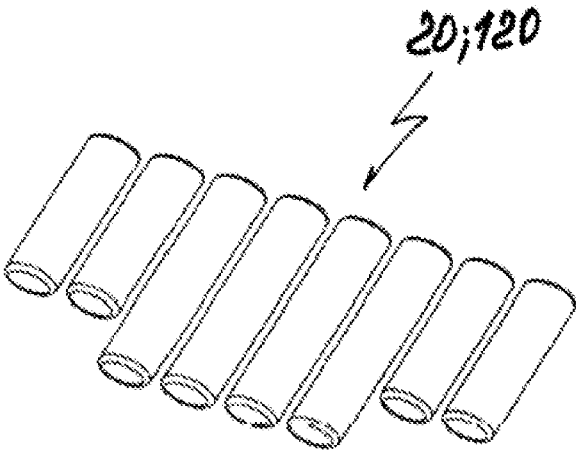

Each tool may also comprise housings and weights with a different form and weight, as for example shown in FIGS. 29-31; said weights may also be suitably combined for a more effective action on the corresponding underlying muscles.

The present invention relates furthermore to a kit 400 for tonifying the face and neck muscles, which comprises at least two and preferably all of the following:

- a first strip-like tool with weights of uniform length; and/or
- a second strip-like tool with central weights of greater length; and/or
- a third L-shaped tool; and/or
- a fourth tool shaped as a hollow rectangle 310.

Figure 24:
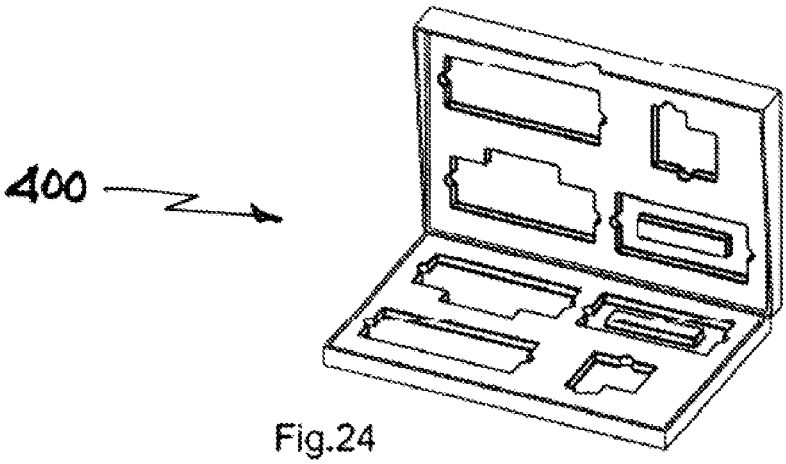
FIG. 24: shows a perspective view of a kit comprising tools according to the invention.

The kit is shown by way of example in FIG. 24 with a storage box, the lining of which reproduces the form of the single tools for correct packaging thereof; it is also possible, however, for the tool to be packaged using any other suitable form.

The application of a tool on the corresponding area of the neck and/or face for which it is specifically designed is a preparation step for performing exercises designed to improve the tone of the specific underlying muscles and prevent the formation of unattractive skin bags, sagging of the eyelid tissues and/or blepharochalasis.

A cosmetic method which uses a tool according to the invention is able, by means of one or more of these exercises, to tonify the muscles supporting the dermis, resulting in a visible reduction of the signs of aging. By raising weight loads, the contractive component of the surface muscle (myofibril) not only increases in volume, but also increases the number of myofibrils and the myofibril recruitment capacity (known as "co-contraction"). This allows the muscle to support the dermis, creating tonifying, firming and lifting aesthetic effects, resulting in gradual relaxation of the epidermis and a visible reduction in the signs of aging.

The invention therefore also envisages specific techniques for using the special tools described above for the different parts where the said tools are applied, these techniques forming part of a method for cosmetic treatment according to the invention, which comprises the following steps:

a) arrangement of the person's body in a supine lying-down position;
b) application of a specific tool specially designed for a corresponding specific zone of the face/neck and in particular:
   - a strip with weights of uniform length around the user's neck;
   - a strip with central weights of greater length on the user's forehead;
   - an L-shaped tool on the cheeks of the user;
   - a strip formed as hollow rectangle around the user's mouth;
c) performing one or more specific exercises for the different parts of the face and neck, designed to stress the corresponding muscle.

Preferred examples of such exercises may comprise:

Forehead/Eyelids

The following exercises are particularly preferred for preventing sagging of the upper eyelids and/or restoring elasticity to the top part of the face and/or preventing the formation of wrinkles:

1. Frowning with furrowing of the forehead and eyebrows, as if to imitate an "annoyed or angry" look.
2. Raising the eyebrows and opening the eyes wide.

Cheekbones/Eyelids

The following exercises are particularly preferred for improving the definition and the height of the cheekbones and/or improving the contour of the face:

1. Forming a very open "0" shape with the mouth followed immediately by a very wide "A" shape.
2. Raising the corners of the mouth as if to "smile", while keeping the lips tightly pressed together and squinting with the eyes;
3. Repeating this on both sides of the face for so-called "crow's feet").

Mouth

The following exercises are particularly preferred for preventing or reducing wrinkles (so-called "bar codes");

Puckering and pouting the lips as if to give a kiss.

Neck

The following exercises are particularly preferred for preventing the formation of loose skin around the neck and/or a double chin:

Keeping the head still and forcing the corners of the mouth downwards.

Preferably the method comprises the following rules for carrying out the exercises:

d) Repeating the specific exercises in the following sequences:

Months 1-2-3

Week 1+2+3+4—Isotonic Exercises

Sequence C1:

DAY 1+3+5: work on a single area (30 repetitions per movement)

day 1=forehead and eyelids;

day 3=cheekbones and crow's feet;

day 5=lips and neck

DAY 2+4+6: work on the whole face (10 repetitions per movement)

day 2=carry out the single exercises in the sequence: forehead, cheekbones, lips, neck;

day 4=REPEAT day 6=REPEAT day 7=rest

Week 5+6+7+8—Isometric Exercises

Repeat sequence C1:

DAY 1+3+5: work on a single area (hold movement for 10 sec.—10 repetitions)

Recovery time: 5 sec.)

day 1=forehead and eyelids;

day 3=cheekbones and crow's feet;

day 5=lips and neck

DAY 2+4+6: work on the whole face (hold movement for 10 sec.—5 repetitions.

Recovery time: 5 sec.)

day 2=carry out the single exercises in the sequence: forehead, cheekbones, lips, neck;

day 4=REPEAT day 6=REPEAT

DAY 7=rest

Week 9—Eccentric Isotonic Exercises

Repeat sequence C1

DAY 1+3+5: work on a single area (30 repetitions of movement)

day 1=forehead and eyelids;

day 3=cheekbones and crow's feet;

day 5=lips and neck

DAY 2+4+6: work on the whole face (10 repetitions of movement)

day 2=carry out the single exercises in the sequence: forehead, cheekbones, lips, neck;

day 4=REPEAT day 6=REPEAT

DAY 7=rest

Week 10—Pulse Training Repeat sequence C1

DAY 1+3+5: work on a single area (15 repetitions of the movement every 30 sec. 3 times)

day 1=forehead and eyelids;

day 3=cheekbones and crow's feet;

day 5=lips and neck

DAY 2+4+6: work on the whole face (15 repetitions of the movement)

day 2=carry out the single exercises in the sequence: forehead, cheekbones, lips, neck;

day 4=REPEAT day 6=REPEAT

DAY 7=rest

Week 11—Interval Training

Repeat sequence C1

DAY 1+3+5: work on a single area (perform movement for 10 seconds—10 times.

Recovery time: 5 sec.)

day 1=forehead and eyelids;

day 3=cheekbones and crow's feet;

day 5=lips and neck

DAY 2+4+6: work on the whole face (perform movement for 10 sec.—5 times.

Recovery time: 5 sec.)

day 2=carry out the single exercises in the sequence: forehead, cheekbones, lips, neck;

day 4=REPEAT day 6=REPEAT

DAY 7=rest

Week 12—Maximum Number of Repetitions

C1 work on a single area (perform the maximum number of repetitions for each movement, i.e. as many times as possible, and make a note of the result)

DAY 1+2+3+4+5+6 day 1=forehead (exercise 1);

day 2=forehead (exercise 2);

day 3=right cheekbone day 4=left cheekbone day 5=mouth (kissing movement);

day 6=neck

DAY 7=rest

Month 4—Weight Increase

Week 1 (Warm-Up+Isotonic Training)

DAY 1+3+5: work on a single area (10 repetitions of the movement 3 times using the old weight. Recovery time: 5 sec.)

15 repetitions of the movement using the new weight)

day 1=forehead and eyelids;

day 3=cheekbones and crow's feet;

day 5=lips and neck

DAY 2+4+6: work on the whole face (15 repetitions of the movement using the old weight);

15 repetitions of the movement using the new weight)

day 2=carry out the single exercises in the sequence: forehead, cheekbones, lips, neck;

day 4=REPEAT day 6=REPEAT

DAY 7=rest

Week 2 (Warm-Up+Isometric Training)

DAY 1+3+5: work on a single area (hold movement for 10 sec. 5 times using the old weight. Recovery time: 5 sec.;

Hold movement for 5 sec. 10 times using new weight. Recovery time 5 sec.)

day 1=forehead and eyelids;

day 3=cheekbones and crow's feet;

day 5=lips and neck

DAY 2+4+6: work on the whole face (hold movement for 5 sec. 5 times using the old weight. Recovery time 5 sec.;

Hold movement for 5 sec. 5 times using new weight. Recovery time 5 sec.) day 2=carry out the single exercises in the sequence: forehead, cheekbones, lips, neck;

day 4=REPEAT day 6=REPEAT

DAY 7=rest

Week 3 (INTERVAL TRAINING)

DAY 1+3+5: work on a single area (5 sec. activity 10 times using old weight. Recovery time: 5 sec.;

5 sec. activity 10 times using new weight. Recovery time 5 sec.)
day 1=forehead and eyelids;
day 3=cheekbones and crow's feet;
day 5=lips and neck
DAY 2+4+6: work on the whole face
5 sec. activity 5 times using old weight. Recovery time 5 sec.;
5 sec. activity 5 times using new weight. Recovery time 5 sec.)
day 2=carry out the single exercises in the sequence: forehead, cheekbones, lips, neck;
day 4=REPEAT
day 6=REPEAT
DAY 7=rest
WEEK 4
C1 work on a single area.

Perform the maximum number of repetitions for each movement, i.e. as many times as possible, and make a note of the result (as regards the old weight check the improvement with that obtained in the 12$^{th}$ week)

DAY 1+2+3+4+5+6
day 1=forehead (exercise 1)+forehead (exercise 2); old weight
day 2=right-hand+left-hand cheekbones; old weight
day 3=mouth+neck; old weight
day 4=forehead (exercise 1)+forehead (exercise 2); new weight
day 5=right-hand+left-hand cheekbones; new weight
day 6=mouth+neck; new weight
DAY 7=rest For complete execution of the entire method it is also envisaged that:

the cycle "MONTHS 1-2-3" is repeated each time a new weight is applied/used;
the cycle "MONTH 4" is carried out whenever changing from one weight to a heavier/new weight;
the "MAINTENANCE" cycle (described further below) is preferably carried out only when the final weight is reached.

Figure 32:
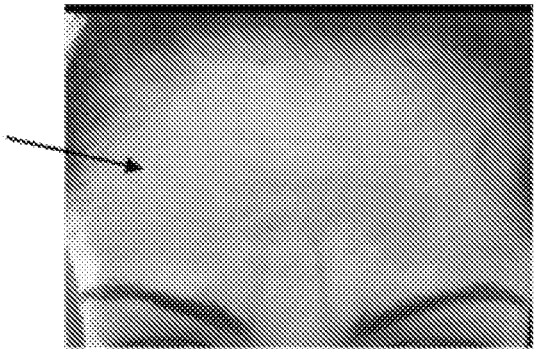
FIGS. 32-33: show views of the forehead of a person before and after performing the exercises according to the method of the invention.
Figure 33:
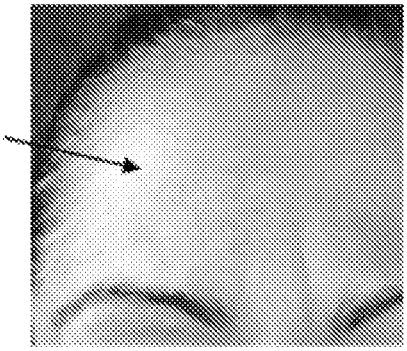

Tests for carrying out the method according to the invention have demonstrated its effectiveness as illustrated in the attached FIGS. 32 and 33 which show the forehead of a person before (FIG. 32) and after (FIG. 33) carrying out the exercises intended for a specific area of the face.

In detail:

a number of persons aged between 35 and 50 underwent a 3-month training cycle, following the various stages for the months 1, 2 and 3.

Week 1+2+3+4—Isotonic Exercises
Sequence C1:
Week 5+6+7+8—Isometric Exercises
Repeat sequence C1:
Week 9—Eccentric Isotonic Exercises
Repeat sequence C1
Week 10—Pulse Training
Repeat sequence C1
Week 11—Interval Training
Repeat sequence C1
Week 12—Maximum Number of Repetitions See previous paragraphs to which reference is made in full here.

The results may be clearly seen with a significant reduction in the wrinkles on the forehead from the initial condition (shown in FIG. 32) to the final condition (shown in FIG. 33).

According to a further preferred aspect, the step c) of the cosmetic method according to present invention may comprise or be formed by one or more exercises for maintaining the tonicity of the superficial muscles of the face and/or neck. A preferred cycle of such exercises is described in detail below.

Maintenance
Month One
Warm-Up 400 g Work 600 g
Week 1
Isotonic Exercise
20 warm-up repetitions (400 g)
3×20 Repetitions (600 g), recovery time 10 sec.
work on a single area:
day 1: forehead
day 3: cheekbones
day 5: lips and neck
work on the whole face: day 2, day 4, day 6
day 7: rest
Week 2
Isometric Exercise
10 sec. activity ×5 repetitions (400 g) with 5 sec. recovery time;
20 sec. activity ×8 repetitions (600 g) with 10 sec. recovery time;
work on a single area:
day 1: forehead
day 3: cheekbones
day 5: mouth and neck
work on the whole face: day 2, day 4, day 6
day 7: rest
Week 3
Isometric exercise repetitions (400 g)
3×20 repetitions with 10 sec. recovery time (600 g)
work on a single area:
day 1: forehead
day 3: cheekbones
day 5: lips and neck
Eccentric Exercise (A.S.A.P.)
20 repetitions (400 g)
40 repetitions (600 g)
work on the whole face: day 2, day 4, day 6
day 7: rest day
Week 4
Climbing Weight Exercise
25 repetitions with 200 g
20 repetitions with 400 g
15 repetitions 600 g
10 repetitions with 800 g
weight change recovery time (5 sec.)
work on a single area:
day 1: forehead
day 3: cheekbones
day 5: mouth and neck
work on the whole face: day 2, day 4, day 6
day 7: rest
Month 2
Warm-up 600 g; work 800 g
Week 1
Isotonic Exercise
20 warm-up repetitions (600 g)
3×20 repetitions, recovery time 10 sec. (600 g)
work on a single area:
day 1: forehead
day 3: cheekbones
day 5: lips and neck
work on the whole face: day 2, day 4, day 6
day 7: rest Week 2 Isometric exercise
10 Sec. Activity ×5 Repetitions, 5 Sec. Recovery, (600 g);
20 sec. activity ×8 repetitions, 10 sec. recovery, (800 g);
work on a single area:
day 1: forehead
day 3: cheekbones
day 5: mouth and neck
work on the whole face: day 2, day 4, day 6
day 7: rest
Week 3
Pulse Exercises
20 repetitions (600 g)
3×20 repetitions, 10 sec. recovery time, (800 g)
work on a single area:
day 1: forehead
day 3: cheekbones
day 5: mouth and neck
Pulse Exercises
20 repetitions (600 g)
40 repetitions (800 g)
work on the whole face: day 2, day 4, day 6
day 7: rest
Week 4
Pulse Exercises
20 repetitions (600 g)
40 repetitions (800 g)
work on a single area:
day 1: forehead
day 3: cheekbones
day 5: mouth and neck
Exercises and Intervals
20 sec. activity (600 g)
20 sec. activity×5 series, 5 sec. recovery, (800 g)—
work on the whole face: day 2, day 4, day 6
day 7: rest
Month 3
Warm-up 800 g work 1 kg
Week 1
Isotonic Exercise
20 warm-up repetitions 800 g
3 series×20 repetitions, 10 sec. recovery time, with 1 kg
work on a single area:
day 1: forehead
day 3: cheekbones
day 5: lips and neck—
work on the whole face: day 2, day 4, day 6
day 7: rest
Week 2
Isometric Exercise
10 sec. activity×5 repetitions, 5 sec. recovery, (800 g);
20 sec. activity×8 repetitions, 10 sec. recovery time; (1 kg)—
work on a single area:
day 1: forehead
day 3: cheekbones
day 5: lips and neck
Isometric Exercise
5 sec. activity×5 repetitions, 5 sec. recovery time, (800 kg)
10 sec. activity×4 repetitions, 10 sec. recovery time, (1 kg)—
work on the whole face: day 2, day 4, day 6
day 7: rest
Week 3
Climbing Weight
25 repetitions 400 g
20 repetitions 600 g
15 repetitions 800 g
10 repetitions 1 kg
weight change recovery time—
work on a single area:
day 1: forehead
day 3: cheekbones
day 5: mouth and neck
Climbing Weight
15 repetitions 1000 g
15 repetitions 800 g
15 repetitions 600 g
weight change recovery time—
work on the whole face: day 2, day 4, day 6
day 7: rest
Week 4
work on the whole face, 60 sec. of continuous movement with 20 sec. recovery time
days 1,2,3,4,5,6
day 7: rest
Month 4
Warm-up 400 g; work 600 g
Week 1
Isotonic Exercise
Warm-Up Repetitions (400 g)
3 series×20 repetitions, 10 sec. recovery (600 g)
work on a single area:
day 1: forehead
day 3: cheekbones
day 5: lips and neck
Isotonic Exercise
20 warm-up repetitions (400 g)
40 repetitions (600 g)
work on the whole face: day 2, day 4, day 6
day 7: rest
Week 2
work on a single area:
day 1: forehead
day 2: cheekbones
day 3: mouth and neck
Isometric Exercise
10 sec. activity×5 repetitions, 5 sec. recovery, (400 g);
20 sec. activity×8 repetitions, 10 sec. recovery, (600 g);
Isometric Exercise
5 sec. activity×5 repetitions, 5 sec. recovery time, (400 kg)
20 sec. activity×4 repetitions, 10 sec. recovery, (600 g);
work on the whole face: day 2, day 4, day 6
day 7: rest
Week 3
work on a single area:
Maximum Effort
day 1 forehead (upwards movement, opening eyes wide)
day 2 forehead (downwards movement, furrowing forehead)
day 3 cheeks
day 4: mouth (kiss)
day 5 mouth (smiles)
day 6 neck
day 7 rest
Week 4
work on the whole face
Isotonic Exercise
day 1:30 repetitions with 200 g
day 2:30 repetitions with 400 g
day 3:30 repetitions with 600 g
day 4:30 repetitions with 800 g
day 5:30 repetitions with 1000 g
day 6:30 repetitions with 600 g
day 7: rest It is therefore clear how with the tool and the method according to the invention it is possible to obtain a tonifying effect on the face muscles such as to prevent and/or reduce the formation of wrinkles, bags, blepharochalasis and the like, without the need to administer artificial products and/or perform surgical operations, and without articular effort, and with lasting effects over time.

In addition, the tools form a system of free weights which can be adapted to the different zones of the face or neck for which they are intended and have small dimensions, are easy to produce and assemble and may be easily used both autonomously by any user, including non-specialized users, and within structures such as beauty centres, gyms and the like.

Although described in connection with a number of embodiments and a number of preferred examples of implementation of the invention, it is understood that the scope of protection of the present patent is determined solely by the claims below.

The invention claimed is:

1. A tool for tonifying superficial muscles of a face and/or neck, extending respectively in a longitudinal direction corresponding to a lengthwise dimension of the tool, a transverse direction corresponding to a widthwise dimension of the tool, and vertical thickness direction of the tool, comprising:

a container comprising several single housings;

a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position;

wherein said container is made of a plastic or rubbery material and said positioning element is formed by the plastic or rubbery material of the external surface of the container with a coefficient of friction such as to ensure a sufficient grip on the specific area of the face and/or neck of the user on which it rests; and wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, and wherein a side extending parallel to the transverse direction of one of the housings is fastened to a corresponding side of an adjacent housing by hinge means designed to allow a degree of freedom for relative rotation of the adjacent housings about the transverse side, and the hinge means are arranged between each said housing and the adjacent housing in the longitudinal direction.

2. The tool according to claim 1, wherein the container comprises two half-shells, each subdivided into recesses designed to contain a fraction of the volume of the respective weight and to form a respective housing of the container once coupled with a respective recess of the other half-shell.

3. The tool according to claim 1, wherein said container is made of silicone material.

4. The tool according to claim 1, wherein a closing means for closing the housings and/or the hinge means are formed by means of ultrasound welding or gluing, able to produce stable non-modifiable fastenings/closures.

5. The tool according to claim 1, wherein said weights have a cylindrical, parallelepiped, or ovoid form.

6. The tool according to claim 1, wherein the positioning element is made of silicone material.

7. The tool according to claim 1, wherein said weights are at least partially internally hollow.

8. The tool according to claim 1, wherein one or more of said weights has one of the following forms:

uniform, cylindrical, elongated in the transverse direction; and/or uniform, cylindrical, with a longitudinal dimension substantially corresponding to a transverse dimension; and/or uniform, parallelepiped, elongated in the transverse direction; and/or uniform, parallelepiped, with a transverse dimension substantially corresponding to the longitudinal dimension.

9. The tool according to claim 1, wherein said weights have a different length in the transverse direction and/or said weights have a different gram weight.

10. The tool according to claim 1, wherein said weights are arranged symmetrically inside the container or said weights are arranged with end weights having a gram weight less than that of all the other weights; intermediate weights with a gram weight greater than that of the end weights; central weights with a gram weight more than that of all the other weights.

11. The tool according to claim 1, wherein the tool has an "L" shaped form.

12. The tool according to claim 1, wherein the tool has a hollow rectangle form.

13. A kit for tonifying the face and neck muscles, comprising at least two tools, wherein each tool of the two tools is the tool according to claim 1.

14. A kit for tonifying face and neck muscles, comprising at least:

a first tool with weights having a uniform, cylindrical or parallelepiped form elongated in a transverse direction;

a second tool with weights having a cylindrical or parallelepiped form with a different length in the transverse direction;

a third tool having a hollow rectangle form; and a fourth tool having an "L" shaped form, wherein each of the first tool, second tool, third tool, and fourth tool is a tool for tonifying superficial muscles of a face and/or neck, extending respectively in a longitudinal direction corresponding to a lengthwise dimension of the tool, the transverse direction corresponding to a widthwise dimension of the tool, and vertical thickness direction of the tool, and includes a container comprising several single housings, and each weight of the weights of the first tool and each weight of the weights of the second tool are singly contained inside a respective housing of the container, wherein at least one external surface of each housing containing each weight has a positioning element made of a material suitable for ensuring stable positioning of the tool when rested on a specific area of the face and/or neck of a user lying with a body of the user in a supine position.

15. A method for cosmetic treatment of a face and/or neck, comprising:

a) positioning a body of the user in the supine position;

b) applying at least one tool to a specific zone of the face and/or neck, wherein the at least one tool is a tool for tonifying superficial muscles of the face and/or neck, extending respectively in a longitudinal direction corresponding to a lengthwise dimension of the tool, a transverse direction corresponding to a widthwise dimension of the tool, and vertical thickness direction of the tool, comprising:

a container comprising several single housings;

a series of weights, each singly contained inside a respective housing of the container, wherein at least one external surface of each housing containing the weights has a positioning element made of a material suitable for ensuring stable positioning of the tool when rested on a specific area of the face and/or neck of the user lying with the body of the user in the supine position;

wherein said container is made of a plastic or rubbery material and said positioning element is formed by the plastic or rubbery material of the external surface of the container with a coefficient of friction such as to ensure a sufficient grip on the specific area of the face and/or neck of the user on which it rests; and wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position;

c) carrying out one or more exercises for one or more of the specific areas of the face and/or neck with the at least one tool applied, so as to act on a corresponding superficial muscle.

16. The method according to claim 15, wherein the at least one tool comprises:

a strip with weights of uniform length applied to the neck of the user; and/or a strip with central weights of greater length applied to a forehead of the user; and/or an L-shaped tool applied onto cheeks of the user; and/or a strip with the shape of a hollow rectangle applied around the mouth of the user.

17. A method for cosmetic treatment of a face and/or neck, comprising:

a) positioning a body in a supine lying down position;

b) applying at least one tool according to a specific area of the face and/or neck, wherein the at least one tool is for tonifying superficial muscles of the face and/or neck, extending in a longitudinal direction corresponding to a lengthwise dimension of the at least one tool, a transverse direction corresponding to a widthwise dimension of the at least one tool, and vertical thickness direction of the at least one tool, and comprises:

a container comprising several single housings, a series of weights, each weight of the series of weights singly contained inside a respective housing of the container, wherein at least one external surface of each housing containing each said weight of the series of weights has a positioning element made of a material suitable for ensuring stable positioning of the tool when rested on the specific area of the face and/or neck of the user lying with the body of the user in the supine position;

wherein the at least one tool further comprises:

a first strip with the series of weights which are of uniform length, applied to the neck of the user, and/or a second strip with the series of weights having central weights of greater length, applied to a forehead of the user, and/or an L-shaped tool applied onto cheeks of the user, and/or a third strip with a hollow rectangle shape applied around a mouth of the user; and c) carrying out one or more exercises for the different specific areas of the face and/or neck with the tool applied, so as to act on a corresponding superficial muscle;

wherein the step c) further comprises one or more of the following exercises:

i. frowning with furrowing of the forehead and eyebrows so as to imitate an annoyed or angry look, and raising the eyebrows and opening the eyes wide;

ii. forming a very open "O" shape with the mouth followed immediately by a very wide "A" shape, raising corners of the mouth as if to "smile", while keeping lips tightly pressed together and squinting with the eyes, and repeating this step on both sides of the face;

iii. puckering and pouting the lips as if to give a kiss; and iv. keeping the head still and forcing the corners of the mouth downwards.

18. A tool for tonifying superficial muscles of a face and/or neck, extending respectively in a longitudinal direction corresponding to a lengthwise dimension of the tool, a transverse direction corresponding to a widthwise dimension of the tool, and vertical thickness direction of the tool, comprising:

a container comprising several single housings;

a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position;

wherein said container is made of a plastic or rubbery material and said positioning element is formed by the plastic or rubbery material of the external surface of the container with a coefficient of friction such as to ensure a sufficient grip on the specific area of the face and/or neck of the user on which it rests;

wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, and wherein the container comprises two half-shells, each subdivided into recesses designed to contain a fraction of the volume of the respective weight and to form a respective housing of the container once coupled with a respective recess of the other half-shell.

19. The tool according claim 18, further comprising a hinge with a longitudinal axis designed to join in the transverse direction a longitudinal side of a housing of the container together with an opposite longitudinal side of an adjacent housing in the transverse direction, so as to allow a degree of freedom for relative rotation of the adjacent housings about the longitudinal axis.

20. The tool according to claim 18, wherein said container is made of silicone material.

21. The tool according to claim 18, wherein a closing means for closing the housings and/or a hinge means are formed by means of ultrasound welding or gluing, able to produce stable non-modifiable fastenings/closures.

22. The tool according to claim 18, wherein said weights have a cylindrical, parallelepiped, or ovoid form, and/or wherein said weights are at least partially internally hollow.

23. The tool according to claim 18, wherein one or more of said weights has one of the following forms:

uniform, cylindrical, elongated in the transverse direction;

uniform, cylindrical, with a longitudinal dimension substantially corresponding to the transverse dimension;

uniform, parallelepiped, elongated in the transverse direction;

uniform, parallelepiped, with a transverse dimension substantially corresponding to the longitudinal dimension.

24. The tool according to claim 18, wherein said weights have a different length in the transverse direction and/or said weights have a different gram weight.

25. The tool according to claim 18, wherein said weights are arranged symmetrically inside the container or said weights are arranged with end weights having a gram weight less than that of all the other weights; intermediate weights with a gram weight greater than that of the end weights; central weights with a gram weight more than that of all the other weights.

26. The tool according to claim 18, wherein the tool has an "L" shaped form or a hollow rectangle form.

27. A kit for tonifying the face and neck muscles, comprising at least two tools, wherein each tool of the two tools is the tool according to claim 18.

28. A tool for tonifying superficial muscles of a face and/or neck, extending respectively in a longitudinal direction corresponding to a lengthwise dimension of the tool, a transverse direction corresponding to a widthwise dimension of the tool, and vertical thickness direction of the tool, comprising:

a container comprising several single housings;

a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position;

wherein said container is made of a plastic or rubbery material and said positioning element is formed by the plastic or rubbery material of the external surface of the container with a coefficient of friction such as to ensure a sufficient grip on the specific area of the face and/or neck of the user on which it rests;

wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, and further comprising a hinge with a longitudinal axis designed to join in the transverse direction a longitudinal side of a housing of the container together with an opposite longitudinal side of an adjacent housing in the transverse direction, so as to allow a degree of freedom for relative rotation of the adjacent housings about the longitudinal axis.

29. The kit according to claim 27, wherein for each tool of the two tools, a longitudinal axis is between each housing and an adjacent housing in the transverse direction.

30. The tool according to claim 27, wherein said container is made of silicone material.

31. A tool for tonifying superficial muscles of a face and/or neck, extending respectively in a longitudinal direction corresponding to a lengthwise dimension of the tool, a transverse direction corresponding to a widthwise dimension of the tool, and vertical thickness direction of the tool, comprising:

a container comprising several single housings;

a series of weights, each singly contained inside a respective housing of the container, wherein at least one external surface of each housing containing the weights has a positioning element made of a material suitable for ensuring stable positioning of the tool when rested on a specific area of the face and/or neck of a user lying with a body of the user in a supine position;

wherein said container is made of a plastic or rubbery material and said positioning element is formed by the plastic or rubbery material of the external surface of the container with a coefficient of friction such as to ensure a sufficient grip on the specific area of the face and/or neck of the user on which it rests;

wherein the tool does not include any retaining means which fasten the tool to the user such that it can be worn, whereby the tool acts by making use solely of a gripping action of the positioning element on the specific area and a force of gravity, when the tool is placed on the specific area of the face or neck of the user lying in the supine position, and wherein the tool has an "L" shaped form or a hollow rectangle form.

* * * * *